US006357255B1

(12) United States Patent
Onishi et al.

(10) Patent No.: US 6,357,255 B1
(45) Date of Patent: Mar. 19, 2002

(54) REGENERATOR FOR USE IN AMMONIA ABSORPTION REFRIGERATOR

(75) Inventors: Hisashi Onishi; Yukio Hiranaka; Noboru Tsubakihara, all of Osaka; Katsuo Iwata, Amagasaki; Tetsuro Furukawa, Osaka; Masaharu Furutera, Osaka; Mitsunobu Matsuda, Osaka; Suguru Fujita, Osaka; Takeshi Yano, Osaka, all of (JP)

(73) Assignees: Osaka Gas Co., Ltd.; Sumitomo Precision Products Co., Ltd.; Hitachi Zosen Corporation, all of (JP)

( * ) Notice: Subject to any disclaimer, the term of this patent is extended or adjusted under 35 U.S.C. 154(b) by 0 days.

(21) Appl. No.: 09/555,061

(22) PCT Filed: Sep. 24, 1998

(86) PCT No.: PCT/JP98/04305

§ 371 Date: May 23, 2000

§ 102(e) Date: May 23, 2000

(87) PCT Pub. No.: WO00/17587

PCT Pub. Date: Mar. 30, 2000

(51) Int. Cl.[7] ..... F25B 33/00
(52) U.S. Cl. ..... 62/497; 62/271; 62/476
(58) Field of Search ..... 62/497, 271, 476, 62/495; 122/155.2; 165/909

(56) References Cited

U.S. PATENT DOCUMENTS 3,834,864 A * 9/1974 Jakobi et al.
4,106,309 A * 8/1978 Phillips ..... 62/476
4,487,036 A * 12/1984 Itoh et al. ..... 62/497 X
5,435,154 A * 7/1995 Nishiguchi et al. ..... 62/476
5,666,818 A * 9/1997 Manruque-Valadez .... 62/497 X
6,771,711 * 6/1998 Kubota ..... 62/497
5,916,258 A * 6/1999 Cho ..... 62/476

FOREIGN PATENT DOCUMENTS

| | | | |
|---|---|---|---|
| JP | 57-108566 | | 7/1982 |
| JP | 57-108566 A | * | 7/1982 |
| JP | 58-6375 | | 1/1983 |
| JP | 59-129306 | | 7/1984 |
| JP | 69-129306 A | * | 7/1984 |
| JP | 60-152803 | | 8/1985 |
| JP | 03122467 A | * | 5/1991 |
| JP | 04116356 A | * | 4/1992 |
| JP | 7-318196 | | 12/1995 |
| JP | 07318196 A | * | 12/1995 |
| JP | 9-280690 | | 10/1997 |
| JP | 10030859 A | * | 2/1998 |

* cited by examiner

*Primary Examiner*—Henry Bennett
*Assistant Examiner*—Chen-Wen Jiang
(74) *Attorney, Agent, or Firm*—D. Peter Hochberg; Katherine R. Vieyra; William H. Holt

(57) ABSTRACT

A regenerator for use in an ammonia absorption refrigerator comprises a heater for heating an ammonia aqueous solution and a rectifying column for enriching ammonia in an ammonia solution-vapor mixture obtained in and introduced from the heater, wherein the heater comprises a heater body having a heating chamber, a burner of lean pre-mixture combustion type disposed in a lower portion of the heating chamber, and a heat transfer tube bundle provided in a meandering arrangement above the burner within the heating chamber, the heat transfer tube bundle having an inlet and an outlet which are respectively connected to lower portions of the rectifying column via transfer pipes.

9 Claims, 11 Drawing Sheets

REGENERATOR FOR USE IN AMMONIA ABSORPTION REFRIGERATOR

TECHNICAL FIELD

The present invention relates to a regenerator for use in an ammonia absorption refrigerator.

BACKGROUND ART

Conventionally, a heater of smoke tube type is used for a regenerator in an ammonia absorption refrigerator.

More specifically, as shown in FIG. 11, the heater 101 comprises a cylindrical heater body 102 disposed below a rectifying column 111, a cylindrical combustion chamber 103 disposed in a lower portion of the heater body 102, heat transfer tubes 104 disposed above the combustion chamber 103, and an smoke passage 105 for introducing combustion gas resulting from combustion in the combustion chamber 103 into the heat transfer tubes 104.

In the aforesaid arrangement, the combustion gas from the combustion chamber 103 is introduced into the heat transfer tubes 104 via the smoke passage 105 so that a strong ammonia aqueous solution supplied into the heater body 102 is heated for separation of ammonia by evaporation thereof.

With the aforesaid arrangement, however, the heater of smoke tube type has a complicated construction, requiring much time for manufacture, inspection and maintenance thereof. This leads to a problem of increases in production costs and running costs.

It is therefore an object of the present invention to provide a regenerator for use in an ammonia absorption refrigerator which features lower production costs and easy maintenance.

DISCLOSURE OF THE INVENTION

In accordance with the present invention, there is provided a regenerator for use in an ammonia absorption refrigerator, the regenerator comprising a heater for heating an ammonia aqueous solution and a rectifying column for enriching ammonia in an ammonia solution-vapor mixture obtained in and introduced from the heater, wherein the heater comprises a heater body having a heating chamber, a burner disposed in a lower portion of the heating chamber, and a heat transfer tube bundle provided in a meandering arrangement above the burner within the heating chamber, the heat transfer tube bundle having an inlet and an outlet which are respectively connected to lower portions of the rectifying column via transfer pipes.

In accordance with another aspect of the invention, the heat transfer tube bundle of the heater of the regenerator having the aforesaid construction has an orifice provided at the inlet thereof and a fin provided on an outer circumferential surface thereof, and a lean pre-mixture combustion type ceramic burner is used as the burner, wherein the heat transfer tube bundle is exposed to flames of the burner.

The regenerator, in which the heater body is provided separately from the rectifying column, the lean pre-mixture combustion type ceramic burner is disposed in the lower portion of the heating chamber and the heat transfer tube bundle is provided in an meandering arrangement within the heating chamber, has a simple and compact construction, compared with a regenerator having a heater provided integrally with a rectifying column therebelow. This arrangement facilitates maintenance and inspection of the regenerator. Since the heater has a compact construction, the amount of the ammonia aqueous solution to be retained therein is reduced, thereby improving the safety.

In accordance with further another aspect of the invention, the rectifying column of the regenerator has a gas-liquid separation space provided in a lower portion of a column body for separating ammonia from the ammonia aqueous solution, and first and second pooling chambers separated by a partition wall of a predetermined height provided on the bottom of the column body, in order that an ammonia aqueous solution pooled in the first pooling chamber is introduced into the heater via one of the transfer pipes and the ammonia aqueous solution heated in the heater is introduced into the gas-liquid separation space above the second pooling chamber via the other transfer pipe, the rectifying column further having a baffle plate provided in the column body for guiding downward into the second pooling chamber the heated ammonia aqueous solution supplied into the gas-liquid separation space via the other transfer pipe.

With this arrangement, the lower portion of the column body of the rectifying column is partitioned by the partition wall into the separate pooling chambers in which the ammonia-rich aqueous solution supplied into the column body from an absorber and the weak ammonia aqueous solution resulting from vapor separation by the heating in the heater are respectively pooled. Therefore, the concentration of the weak ammonia aqueous solution taken out of the second pooling chamber can be kept constant. That is, the regeneration efficiency can be improved.

BEST MODE FOR EMBODYING THE INVENTION

The present invention will be described in greater detail with reference to the attached drawings.

Figure 1:
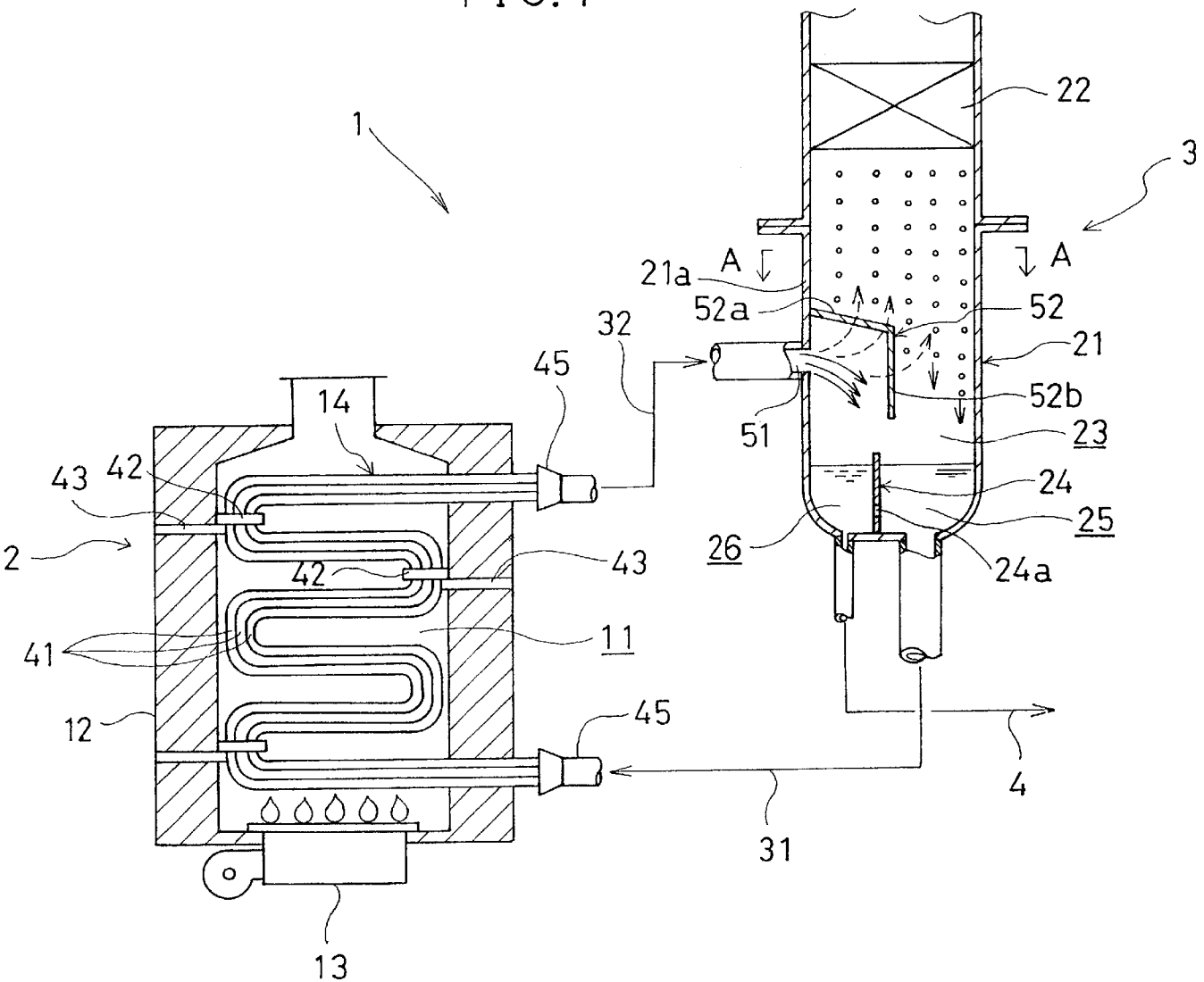
FIG. 1 is a sectional view of a regenerator according to a preferred embodiment of the invention.

FIG. 1 illustrates a section of a regenerator for use in an ammonia absorption refrigerator.

As shown in FIG. 1, the regenerator 1 comprises a heater (regeneration section) 2 for heating an ammonia aqueous solution, and a lower part of a rectifying column 3 for introducing therein and heating an ammonia solution-vapor mixture (containing ammonia vapor and steam) for enrichment (distillation) of ammonium contained in the ammonia solution-vapor mixture.

The heater 2 comprises a heater body 12 having a heating chamber 11 of a box shape, a lean pre-mixture combustion type ceramic burner 13 (one exemplary type of burners) disposed on the bottom of the heater body 12, and a heat transfer tube bundle 14 disposed above the ceramic burner 13 in the heating chamber 11 of the heater body 12.

Figure 4:
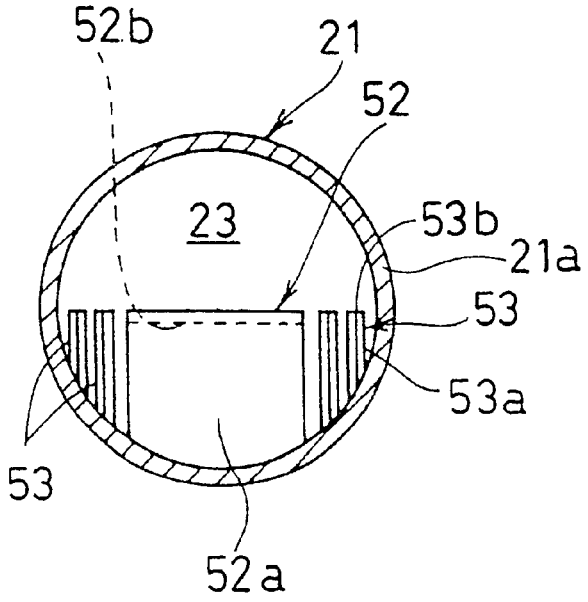
FIG. 4 is a sectional view taken along a line A—A in FIG. 1.

As shown in FIGS. 1 and 4, the rectifying column 3 comprises a vertical cylindrical column body 21.. A filler 22 is provided in an upper portion of the column body, and a gas-liquid separation space 23 is provided in a lower portion of the column body for separation of ammonia.

A bottom portion of the column body 21 which serves as a liquid pool is separated into a first pooling chamber 25 and a second pooling chamber 26 by a partition wall 24 of a predetermined height provided therein.

An inlet of the heat transfer tube bundle 14 is connected to the first pooling chamber 25 of the rectifying column 3 via a liquid supplying transfer pipe 31, while an outlet of the heat transfer tube bundle 14 is connected to the gas-liquid separation space 23 located above the second pooling chamber 26 of the rectifying column 3 via a liquid returning transfer pipe 32.

The heat transfer tube bundle 14 comprises a plurality of heat transfer tubes 41. The heat transfer tubes 41 are bundled up by fixture plates 42 which also serve as baffle plates, and are supported by support fixtures 43 fixed to the heater body 12. A portion between the inlet and outlet of the heat transfer tube bundle 14 is bent back and forth, i.e., in a meandering arrangement.

Figure 2:
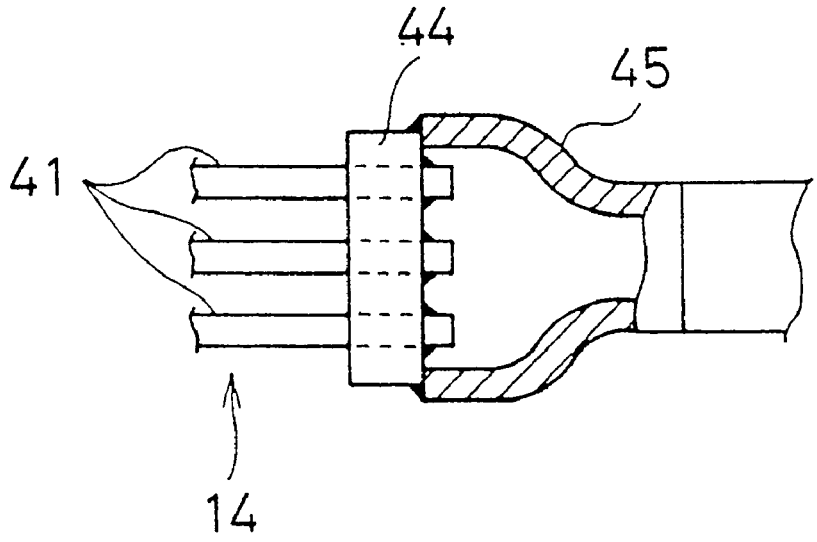
FIG. 2 is a sectional view of an end portion of a heat transfer tube bundle of the regenerator.

As shown in FIG. 2, inlets and outlets of the heat transfer tubes 41 are connected via connection plates 44 to reducers 45, which are connected to the liquid supplying transfer pipe 31 and the liquid returning transfer pipe 32, respectively.

Figure 3:
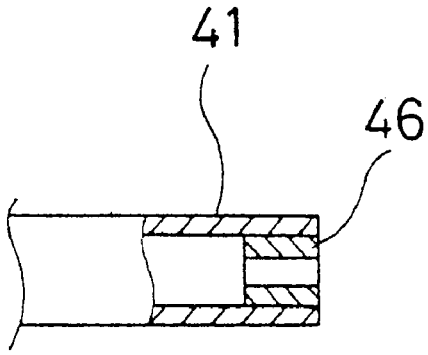
FIG. 3 is a sectional view of an end portion of a heat transfer tube of the regenerator.

As shown in FIG. 3, the inlets of the respective heat transfer tubes 41 of the heat transfer tube bundle 14 on the inlet side are each provided with an orifice 46 for limiting the amount of the ammonia aqueous solution flowing therethrough.

The lean pre-mixture combustion type ceramic burner 13 which is one of pre-mixture combustion type burners, has outlets such as formed of a ceramic, a porous metal plate or a metal net, and is capable of combustion for plural-pipe heating. That is, the heat transfer tube bundle 14 is exposed to (or brought into contact with) part of flames of the burner 13.

As shown in FIG. 1, a baffle plate 52 for forcedly guiding downward into the second pooling chamber 26 the heated ammonia aqueous solution supplied (discharged) into the column body 21 from an opening 51 connected to the liquid returning transfer pipe 32 is provided in association with the opening 51 within the column body 21 of the rectifying column 3.

The baffle plate 52 has an inclination portion 52*a* projecting diagonally downward from a side wall portion 21*a* of the column body 21, and a vertical portion 52*b* extending downward from a distal edge of the inclination portion 52*a*. The baffle plate 52 has a relatively small width (e.g., about ½ to ⅔ of the diameter of the column body) such that communication spaces are defined between itself and the side wall portion 21*a* of the column body 21 to permit the ammonia saturated steam to flow upward.

As shown in FIG. 4, a plurality of tray members 53 are arranged in juxtaposition in the communication spaces defined between the opposite edges of the baffle plate 52 and the side wall portion 21*a* of the column body 21 to prevent, as much as possible, the ammonia-rich aqueous solution dropping into the communication spaces from entering the weak ammonia aqueous solution in the second pooling chamber 26. The tray members 53 each have an inclined V-shaped tray portion 53*a* and a vertical portion 53*b*.

Further, a through-hole 24*a* is formed in a lower portion of the partition wall 24 to provide communication between the pooling chambers 25 and 26 for automatic liquid level adjustment in the pooling chambers 25, 26.

With the aforesaid arrangement, the ammonia-rich aqueous solution which has been enriched with ammonia by absorption of ammonia in an absorber is supplied into the column body 21 from a feeding section of the rectifying column 3, and drops into the column body 21 thereby to be pooled in the first pooling chamber 25.

The ammonia aqueous solution pooled in the first pooling chamber 25 is transported into the heat transfer tube bundle 14 of the heater 2 via the liquid supplying transfer pipe 31. The ammonia aqueous solution is efficiently heated to not lower than a saturation temperature in the heat transfer tube bundle while being transported from the inlet thereof on the lower side to the outlet thereof on the upper side, and then transported via the liquid returning transfer pipe 32 to be discharged into the gas-liquid separation space 23 from the opening 51 of the column body 21.

The heated ammonia solution-vapor mixture discharged into the column body 21 bumps against the baffle plate 52, and is forced to be deflected downward. The liquid component of the mixture drops into the second pooling chamber 26, while the gas component of the mixture flows upward through the communication spaces on the opposite sides of the baffle plate 52 to the filler 22 thereby to be condensed. Most of the ammonia-rich aqueous solution dropping into the communication spaces is guided into the first pooling chamber 25 by the tray portions 53*a* of the tray members 53.

The weak ammonia liquid component pooled in the second pooling chamber 26 is transported into the absorber via a transfer pipe 4.

The regenerator, in which the heater body 12 is provided separately from the rectifying column 3 and the lean pre-mixture combustion type ceramic burner 13 is provided on the bottom of the heating chamber 11 with the heat transfer tube bundle 14 being provided in a meandering arrangement in the heating chamber 11, has a simple and compact construction, compared with the regenerator in which the heater is provided integrally with the rectifying column 3 therebelow. This facilitates maintenance and inspection of the regenerator. Further, the inlets of the heat transfer tubes of the heat transfer tube bundle 14 are each provided with the orifice 46 and, therefore, the flow of the ammonia aqueous solution through the heat transfer tube bundle 14 can be kept uniform.

Since the heat transfer tube bundle 14 is exposed to part of flames of the lean pre-mixture combustion type ceramic burner 13, the flame temperature can be kept lower, e.g., at a temperature of not higher than 1,200° C., thereby suppressing $NO_x$ generation.

The lower portion of the column body 21 of the rectifying column 3 is partitioned by the partition wall 24, so that the ammonia-rich aqueous solution supplied into the column body 21 from the absorber and the weak ammonia aqueous solution resulting from vapor separation by the heating in the heater 2 are pooled in the separate pooling chambers 25 and 26, respectively. Therefore, the concentration of the weak ammonia aqueous solution taken out of the second pooling chamber 26 can be kept constant. Accordingly, the regenerator has an improved regeneration efficiency over a regenerator which is provided with no partition wall so that the ammonia-rich aqueous solution supplied into the rectifying column is mixed with the weak ammonia aqueous solution from which ammonia has been evaporated.

Figure 5:
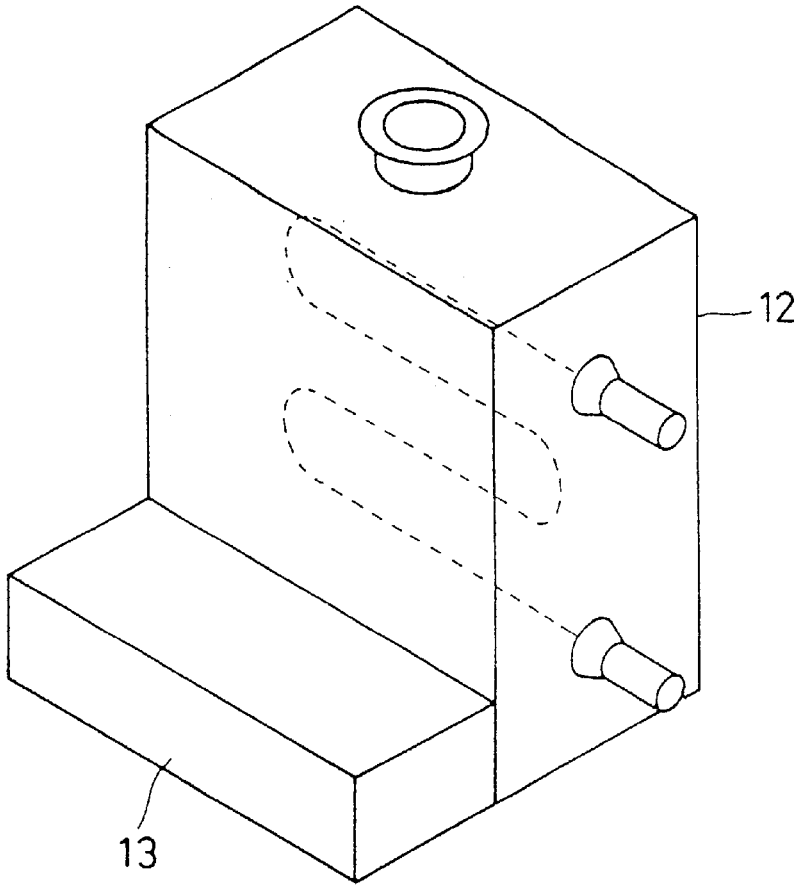
FIG. 5 is a perspective view illustrating a modification of a heater of the regenerator according to the invention.
Figure 6:
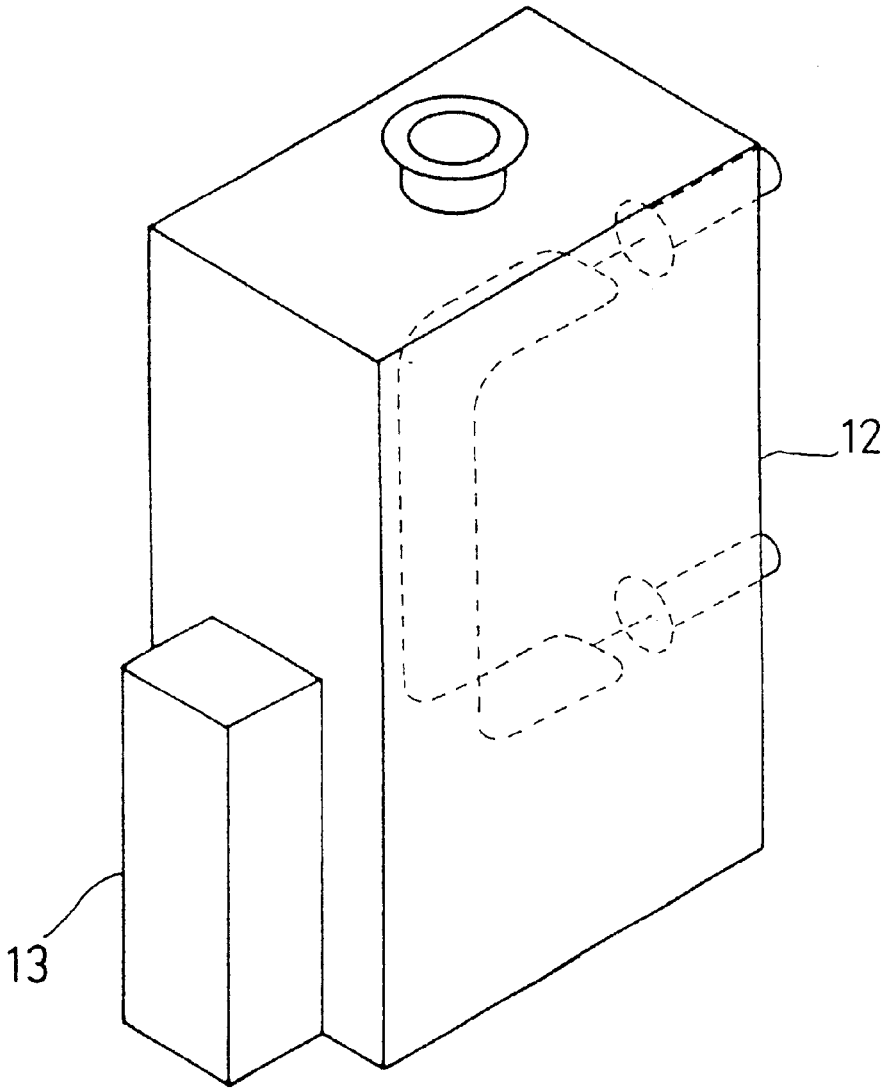
FIG. 6 is a perspective view illustrating another modification of the heater of the regenerator according to the invention.

Although the lean pre-mixture combustion type ceramic burner 13 is disposed on the bottom of the heater body 12 in the embodiment described above, the lean pre-mixture combustion type ceramic burner 13 may be horizontally disposed on the lower lateral side of the heater body 12 as shown in FIG. 5, or vertically disposed on the lower lateral side of the heater body 12 as shown in FIG. 6.

Figure 7:
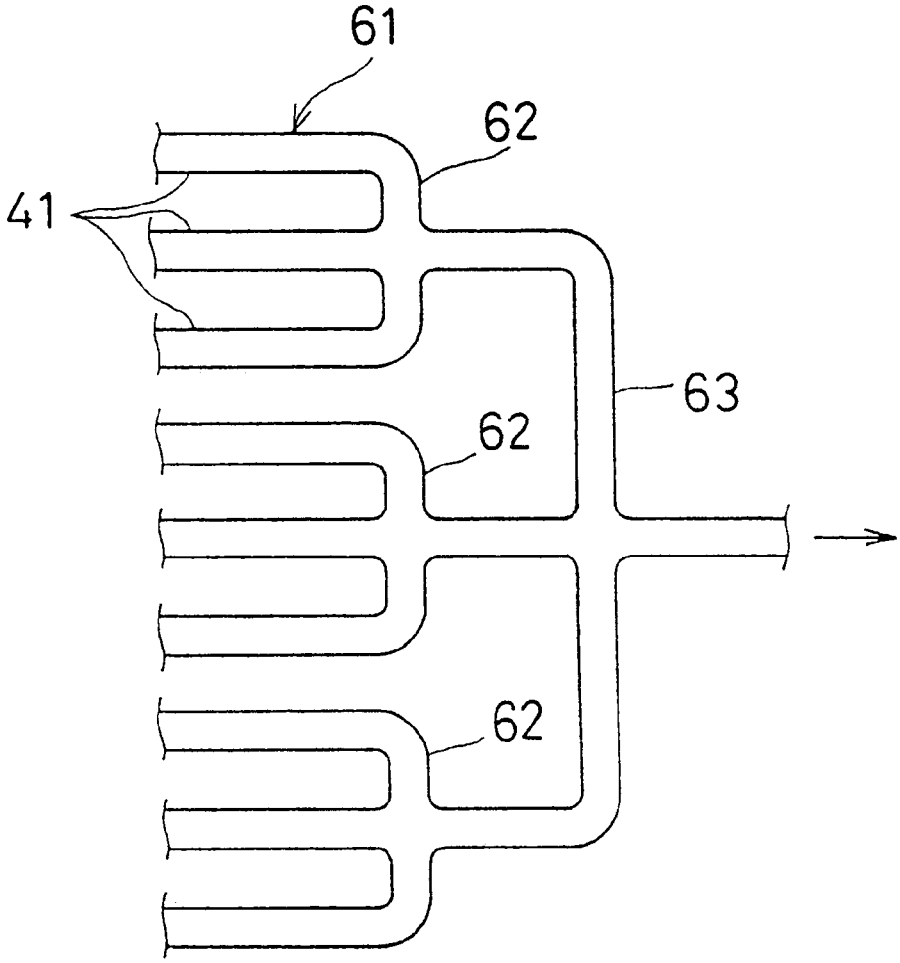
FIG. 7 is a plan view illustrating a major portion of a modification of the end portion of the heat transfer tube bundle of the regenerator according to the invention.

Although the heat transfer tube bundle 14 comprises one set of plural heat transfer tubes 41 in the embodiment described above, the heat transfer tube bundle 14 may comprise plural (e.g., three) sets of plural (e.g., three) heat transfer tubes 41 provided in juxtaposition as shown in FIG. 7. The heat transfer tubes are combined together on two stages by means of headers 62, 63 at the inlet and outlet of the heat transfer tube bundle, and connected to the liquid supplying transfer pipe 31 and the liquid returning transfer pipe 32. In this case, the heat transfer tubes 41 are each provided with an orifice on the inlet side.

Though not shown, fins may be provided on portions of the heat transfer tubes of the heat transfer tube bundle in the aforesaid embodiment or in the modified embodiment where the combustion gas temperature is low (e.g., 700° C. or lower) for improvement of heat exchange efficiency.

Figure 8:
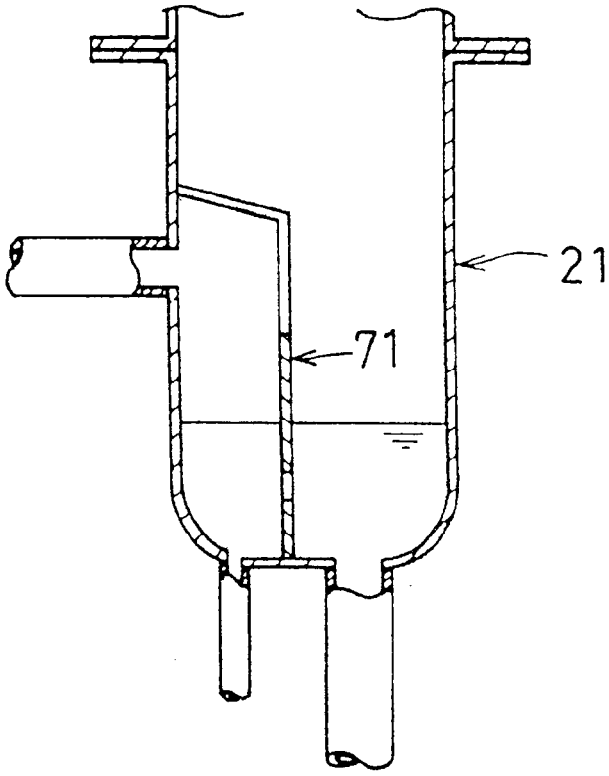
FIG. 8 is a sectional view illustrating a major portion of a modification of a rectifying column of the regenerator according to the invention.

Although the baffle plate is provided separately from the partition wall in the aforesaid embodiment, a partitioning member 71 composed integrally of the baffle plate and the partition wall may be provided in the lower portion of the column body 21 as shown in FIG. 8.

Figure 9:
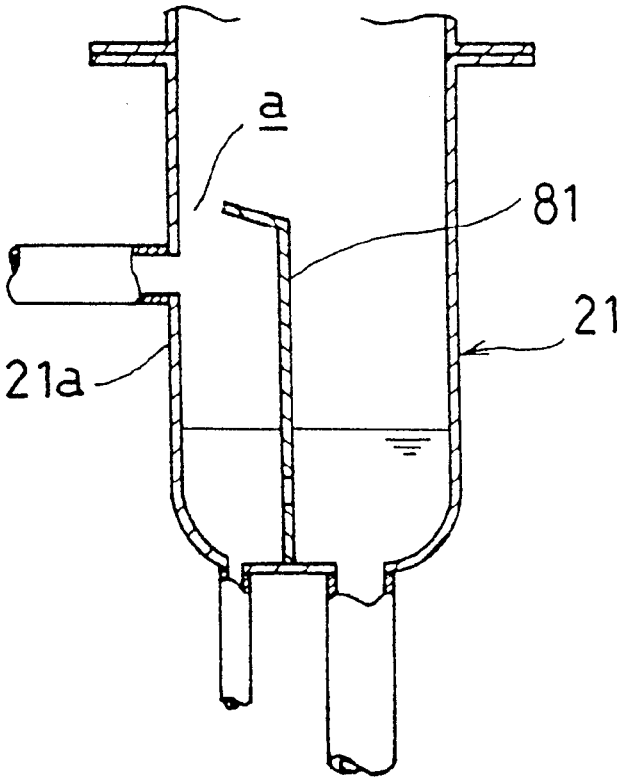
FIG. 9 is a sectional view illustrating a major portion of another modification of the rectifying column of the regenerator according to the invention.
Figure 10:
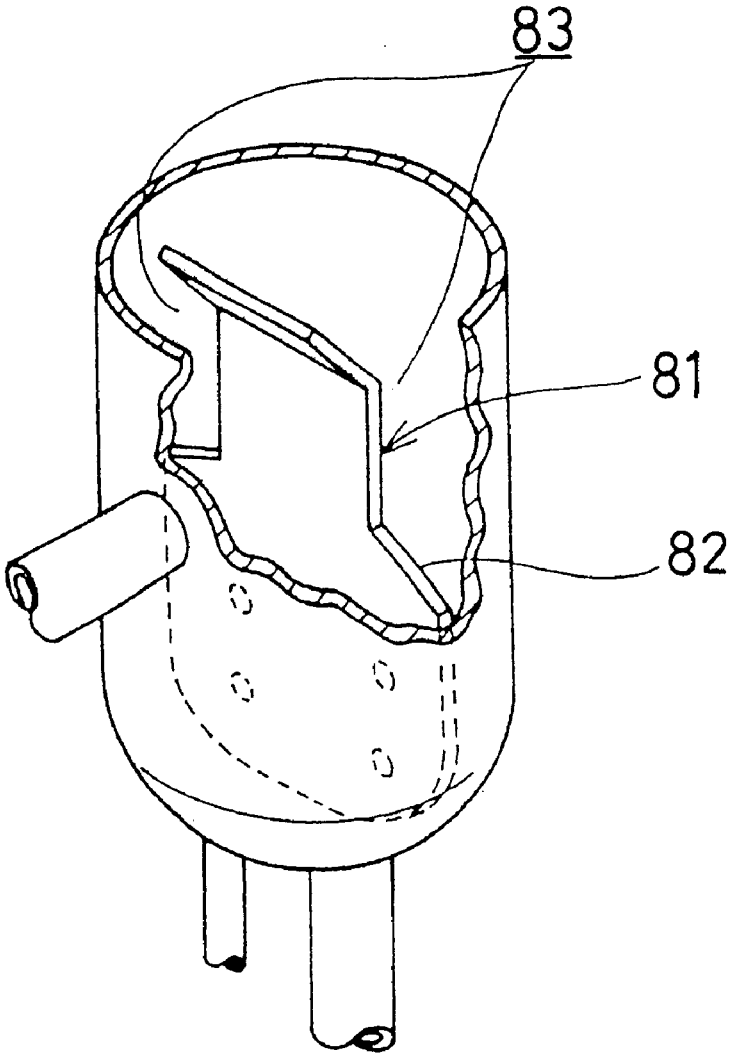
FIG. 10 is a perspective view illustrating the major portion of the rectifying column shown in FIG. 9.
Figure 11:
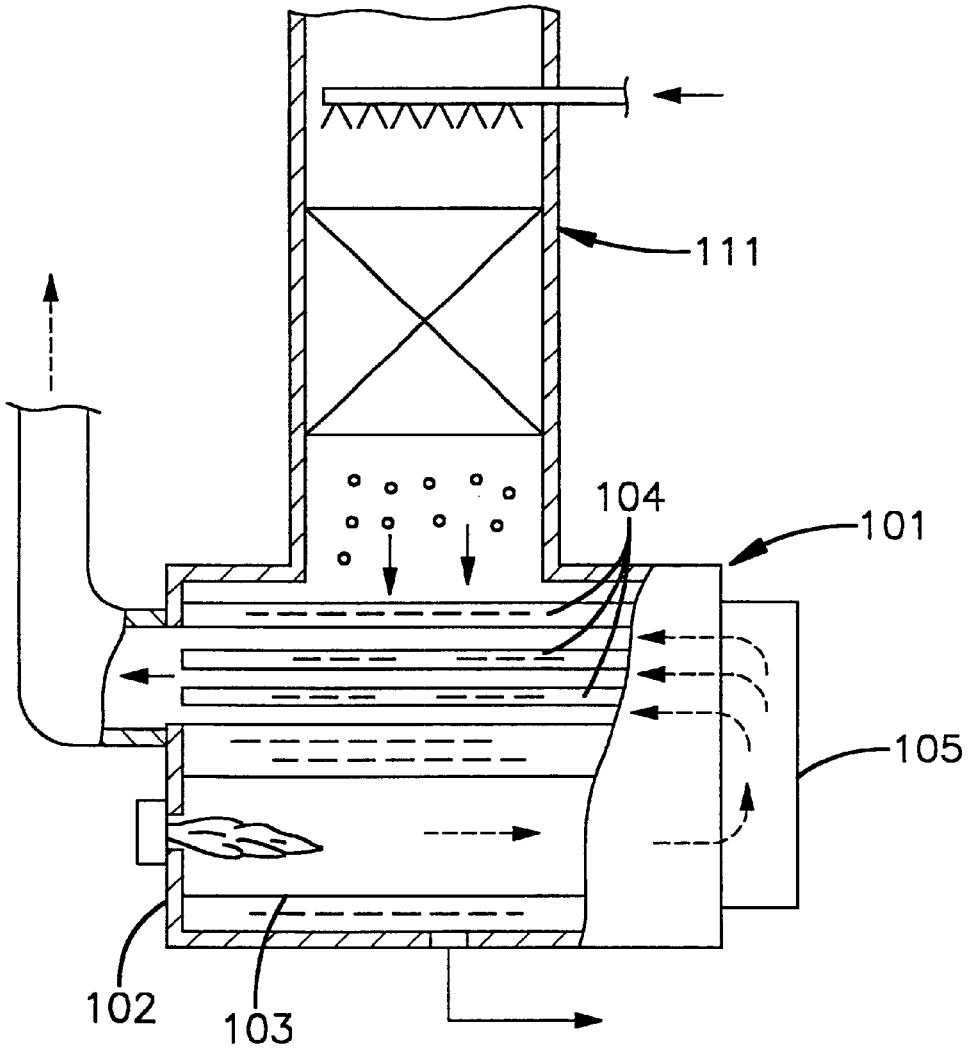
FIG. 11 PRIOR ART
FIG. 11 is a sectional view of a regenerator for use in a conventional ammonia absorption refrigerator.

Alternatively, a partitioning member 81 composed integrally of the baffle plate and the partition wall may be provided to project upward from the bottom to define a gap 'a' between an upper edge thereof and the side wall portion 21*a* of the column body 21 as shown in FIG. 9. As illustrated in the perspective view of the partitioning member 81 in FIG. 10, a portion of the partitioning member 81 upper than a partitioning portion 82 which separates the respective pooling chambers has a predetermined width, and communication spaces 83 are formed on the opposite sides thereof to permit the ammonia vapor to flow upward as described in the above embodiment.

Though not shown, tray members for preventing the ammonia-rich aqueous solution from dropping into the weak ammonia aqueous solution in the second pooling chamber as shown in FIG. 4 are provided in the communication spaces 83 or in communication spaces shown in FIG. 8.

Although the tray members are provided on the opposite sides of the baffle plate in accordance with the foregoing explanation, the baffle plate may be constructed to have a greater width and to have V-shaped tray portions on lateral opposite sides of the inclination portion thereof.

INDUSTRIAL APPLICABILITY

As described above, the regenerator according to the present invention is very useful for use in an ammonia absorption refrigerator for simplification and size reduction of the refrigerator.

What is claimed is:

1. A regenerator for use in an ammonia absorption refrigerator, the regenerator comprising a heater for heating an ammonia aqueous solution and a rectifying column for enriching ammonia in an ammonia solution-vapor mixture obtained in and introduced from the heater, wherein the heater comprises:

a heater body having a heating chamber, a burner disposed in a lower portion of the heating chamber, and a heat transfer tube bundle provided in a meandering tube arrangement above the burner within the heating chamber, the heat transfer tube bundle having an inlet and an outlet which are respectively connected to lower portions of the rectifying column via transfer pipes; and the rectifying column has a gas-liquid separation space provided in a lower portion of a column body for separating ammonia from the ammonia aqueous solution, and first and second pooling chambers separated by a partition wall of a predetermined height provided on the bottom of the column body, in order that an ammonia aqueous solution pooled in the first pooling chamber is introduced into the heating chamber via one of the transfer pipes and the ammonia aqueous solution heated in the heater is introduced into the gas-liquid separation space above the second pooling chamber via the other transfer pipe, the rectifying column further having a baffle plate provided in the column body for guiding downward into the second pooling chamber the heated ammonia aqueous solution supplied into the gas-liquid separation space via the other transfer pipe.

2. A regenerator for use in an ammonia absorption refrigerator as set forth in claim 1, wherein the heat transfer tube bundle has an orifice provided at the inlet thereof.

3. A regenerator for use in an ammonia absorption refrigerator as set forth in claim 1, wherein the heat transfer tube bundle has a fin provided on an outer circumferential surface thereof.

4. A regenerator for use in an ammonia absorption refrigerator as set forth in claim 1, wherein the heat transfer tube bundle has an orifice provided at the inlet thereof and a fin provided on an outer circumferential surface thereof.

5. A regenerator for use in an ammonia absorption refrigerator as set forth in claim 1, wherein the heat transfer tube bundle has an orifice provided at the inlet thereof and a fin provided on an outer circumferential surface thereof; a lean pre-mixture combustion type ceramic burner is used as the burner; and the heat transfer tube bundle is exposed to flames of the burner.

6. A regenerator for use in an ammonia absorption refrigerator as set forth in claim 1, wherein the partition wall is formed with a through-hole for communication between the first pooling chamber and the second pooling chamber.

7. A regenerator for use in an ammonia absorption refrigerator as set forth in claim 1, wherein the partition wall and the baffle plate are formed into an integral member.

8. A regenerator for use in an ammonia absorption refrigerator as set forth in claim 1, wherein the partition wall and the baffle plate are formed into an integral member, and the partition wall is formed with a through-hole for communication between the first pooling chamber and the second pooling chamber.

9. A regenerator for use in an ammonia absorption refrigerator as set forth in claim 1, wherein a lean pre-mixture combustion type ceramic burner is used as the burner, and the heat transfer tube bundle is exposed to flames of the burner.

* * * * *